United States Patent [19]

DePirro

[11] 4,047,356

[45] Sept. 13, 1977

[54] POST FOOTING FORM HOLDER AND STABILIZER SYSTEM

[76] Inventor: Mario Louis DePirro, 511 S. Highland Ave., Lombard, Ill. 60148

[21] Appl. No.: 642,724

[22] Filed: Dec. 22, 1975

[51] Int. Cl.[2] ..... E02D 27/00

[52] U.S. Cl. ..... 52/749; 52/146; 52/169.9; 61/53.6; 61/53.64; 249/48; 249/51

[58] Field of Search ..... 61/53.62, 53.6, 53.58, 61/53.52, 53.64; 52/742, 146, 169 R, 292, 294, 297, 298, 295; 249/48, 49, 51; 264/31

[56] References Cited

U.S. PATENT DOCUMENTS

| | | | |
|---|---|---|---|
| 833,791 | 10/1906 | Moran | 52/169 |
| 890,765 | 6/1908 | Gilbreth | 61/53.6 |
| 900,517 | 10/1908 | Glover | 52/298 |
| 1,171,491 | 2/1916 | Woods | 249/51 |
| 3,024,512 | 3/1962 | Dyer | 249/51 |
| 3,397,494 | 8/1968 | Waring | 52/169 |
| 3,514,911 | 6/1970 | Preradovich | 52/298 |
| 3,685,232 | 8/1972 | Steffen | 52/742 |
| 3,745,776 | 7/1973 | Hubby | 61/53.6 |

FOREIGN PATENT DOCUMENTS

| | | | |
|---|---|---|---|
| 546,447 | 2/1932 | Germany | 52/298 |
| 545,912 | 6/1956 | Italy | 249/49 |
| 17,203 | 5/1927 | Netherlands | 61/53.52 |

*Primary Examiner*—Price C. Faw, Jr.
*Assistant Examiner*—Henry Raduazo
*Attorney, Agent, or Firm*—Dominik, Knechtel, Godula & Demeur

[57] ABSTRACT

There is disclosed a post footing form holder and stabilizer system which includes a collar formed by a peripheral side wall and being open at the top and bottom ends thereof, a flange positioned along the bottom edge and extending inwardly for a short distance thereby to act as a bottom stop for a post form inserted within the collar, a plurality of legs mounted on the collar and extending downwardly therefrom and having stop means associated with each leg, each of the stop means being spaced a distance upwardly from the lower end of the legs, and stabilizer means formed by a clamp ring consisting of a ring wall having an interrupted portion, clamp means overlying the interrupted portion and constructed to draw the opposed ends of the interrupted portion together and positionally lock in a closed position, the ring further including a plurality of tie means mounted thereon along the outer surface and a plurality of stabilizer rods constructed for attachment to the tie means at one end, and to the ground surface at the opposed end, the clamp ring being designed for positioning about a post form inserted within the collar and firmly held in position by the clamp means and securing the post form in position by insertion of the stabilizer rods between the clamp ring and the ground such that a post footing may be formed wherein the lower end of the footing has a greater cross sectional diameter than the upper portion of the footing.

7 Claims, 5 Drawing Figures

POST FOOTING FORM HOLDER AND STABILIZER SYSTEM

BACKGROUND OF THE INVENTION

The necessity and use for more efficient construction materials and tools has become evident in view of the greatly increasing costs involved in the construction industry. To this end, a variety of labor saving devices have been developed both from the standpoint of simplifying particular job functions, as well as designing tools to accommodate a given function in a shorter period of time.

It has also become evident in the home construction industry that a wider use is being made of not only mobile homes, but also modular homes. In this connection, it has become desirable to find various efficient means for securing the modular elements or units to a pre-formed foundation or slab, or alternatively, to find more efficient footing systems for mobile homes. It is well known that various tie down systems have been developed with a view toward applying cables for securing mobile homes to the underlying support ground. Such systems, however, have little if any practical use in the field of modular homes. In view of the increasing construction costs, it has now become quite common to employ the modular theory to home construction. Unfortunately, in many such cases, a full foundation is not employed, but rather, only footing systems are employed when assembling modular home units. This, in turn, has required that more efficient footing systems and devices be developed in order to permit ease of construction and assembly of such modular units in position at the home site.

One of the most common footing systems presently employed is to position a plurality of concrete footings spaced peripherally about the area to be covered by the modular units, each of the concrete footings provided with bolts, hooks, or other fastening means cemented directly into the post when pouring the concrete footing in the first instance. The most common concrete post forms and footings which are presently employed are generally poured through a cylindrical tube which is merely inserted in a hole once it is dug and through which concrete is then poured. It will be appreciated that by the use of such systems, the concrete may be poured to any desired level within the cylindrical tube, allowed to dry, and the balance of the tube above the level of the concrete may then be severed such that the entire concrete post with the tube encircled thereabout is left in position and the open area around the post and form is then backfilled with earth. It will further be appreciated that when such systems are employed, the entire post footing is of a unitary dimension and diameter throughout. It is apparent, however, that it would be far preferable to permit the installation of a post footing wherein the lower end of the post footing has a greater cross sectional diameter then the upper portion of the post footing thereby to yield greater stability regardless of the angle of pressure against the post which is held in position. However, in order to provide a post footing wherein the lower portion is of a greater cross sectional diameter than the upper portion, fairly elaborate concrete forms have been utilized. Furthermore, when pouring concrete through the typical cylindrical tube, it is difficult to maintain the tube in a vertically positioned location within the hole since concrete is often poured via the chutes on the concrete truck and any significant amount of contact between the cylindrical tube and the chute has the tendency to cock the form making it difficult to subsequently position the form in a proper vertical position.

In order to attempt to correct the last mentioned problem, stabilizing systems have been used which consist of stabilizer rods nailed or taped to the upper portion of the cylindrical concrete post form and having the opposed ends staked into the ground. It will be appreciated, however, that the function of nailing, taping, or otherwise affixing the stabilizer rod to the post form directly, is a labor consuming job, and in many instances, the point of attachment of the stabilizer rod to the post form is something less than completely secure.

Other difficulties have similarly been experienced with the post footing systems presently in use. For example, the positioning of the post form at the bottom of a post hole, can in many instances cause the resulting post footing to be cocked away from a perfectly 90° vertical angle. This, obviously, is dependent upon the configuration of the bottom of the hole, and in view of the fact that the post form tends to be a cylindrical tube, should the bottom of the hole have ridges or rises in it, it is difficult, if not impossible, to position the post form in a perfectly vertical position. In addition, as was indicated above, where the post form is inserted into the complete depth of the post hole, it is not possible to obtain a post footing wherein the bottom portion of the fitting has a cross sectional diameter greater than the diameter of the post form at a higher level.

The patented art has attempted to provide solutions to these problems in various forms. For example, U.S. Pat. No. 3,024,512 shows a disposable concrete form for posts and columns whereby there is provided a sleeve which may be of any desired parametrical configuration, the sleeve accommodating the positioning of reinforcing rods inserted therethrough. It will be noted that the concrete form and system as shown in U.S. Pat. No. 3,024,512 attempted to overcome various of the problems noted, such as, for example, the stability of the lower portion of the form at the upper end of the hole. It will be noted that the form is provided with flaps which are designed to rest against the upper surface of the hole while the reinforcing rods are inserted through the sleeve and into the hole. Some degree of vertical stability is achieved by driving one of the reinforcement rods into the ground at the bottom of the post hole. Presumably, the concrete or other post footing material is poured through the sleeve and exits at the bottom of the hole thereby to form the post footing. However, it will be noted that the system does not provide for stabilizer rod tie means, and even more importantly, it will be noted that the entire footing below ground level is completely unidimensional and does not include a portion at the lower end thereof which is of a greater cross sectional diameter than the upper portion of the footing. Other problems are similarly evident from a view of the device shown in U.S. Pat. No. 3,024,512 which bear upon the vertical stability thereof when positioned within the hole, as well as a host of other problems.

As was indicated previously, the art has attempted to solve the problem of having a greater cross sectional diameter of the footing at the lower end of the form, however, such attempts have usually entailed the provision of complicated molds or forms. For example, U.S. Pat. No. 1,627,754 shows a mold for footings wherein the mold is constructed to provide an enlarged conical lower section such that the entire post and footing therefor is in a greater degree of vertical and horizontal stability once the footing concrete has dried. It will be observed, however, that the mold is a complicated device and certainly does not lend itself to ease of use in the field.

It will further be appreciated that once the footing has been poured and dried, it is necessary to remove the molds since obviously, it is an expensive item and cannot simply be left in the ground. Hence, this particular solution to the problem has not been adequate nor has the same been employed as a practical matter.

Another attempt at solving the same problem is shown in the art in U.S. Pat. No. 2,448,883 wherein a concrete post form having a conically enlarged lower section is disclosed. However, once again, the subject patent teaches the use of a complete mold, including the lower conical section, in order to achieve the desired end. As indicated previously, it is believed that this is an inefficient system for resolving this problem given the expense of a mold, as well as the expense of labor associated with erecting the mold and disassembling the mold after useage.

Still other solutions are shown in a variety of other prior art patents. For example, U.S. Pat. No. 1,119,711 shows another form of a standing concrete post form which includes reinforcing rods inserted through the center portion of the form and which further include a plurality of radially extending plates adjacent the portion of the form which is at ground level for stabilizing purposes. It will be noted, however, that the variety of problems noted hereinabove certainly are not resolved by the subject patent. In point of fact, molds of this type would certainly not be used in a labor market wherein there is labor associated with both erecting and disassembling the mold or form.

SUMMARY OF THE INVENTION

In summary, the present invention relates to an improved post footing form holder and stabilizer system which permits a post form to be inserted into a post hole and a footing material to be poured therethrough resulting in a footing wherein the lower portion of the footing has a generally greater cross sectional diameter then the cross sectional diameter of the upper portion of the footing thereby to achieve a greater degree of stability both in the vertical and horizontal directions. In addition, the invention provides a simplified stabilizer system to be used in conjunction with the post form holder and post form thereby to permit ease of installation of the corresponding stabilizer rods such that vertical stability of the upper portion of the post form is achieved.

OBJECTS AND ADVANTAGES

It is therefore the principal object of the invention to provide an improved post footing form holder and stabilizer system for use in connection with a post form and stabilizer means for positioning and retaining the post form in its use position, including a collar formed by a peripheral side wall and having open top and bottom ends, the bottom end having a flange positioned along the bottom edge and extending inwardly for a distance, the collar being dimensionally sized to accommodate the positioning of the post form therein and the flange functioning as a bottom stop for the post form once inserted within the collar, a plurality of legs mounted on the collar extending downwardly therefrom and terminating in a lower end, a plurality of stop means mounted on the legs and spaced a distance upwardly from the lower end of the legs to act as a stop for the legs as the same are inserted into the bottom portion of the post hole, and stabilizer means associated with the collar and the post form for stabilizing and maintaining the post form and collar in position when in the use position.

In connection with the foregoing object, it is a further object to provide a post footing form holder and stabilizer system of the type described wherein the stop means mounted on each of the legs comprises a stop plate mounted on each leg and positioned a distance above the lower end of the corresponding leg such as to permit the insertion of the legs into the ground at the lower end of the post hole until the stop plate rests against the surface of the ground thereby preventing any further downward movement of the legs when inserted into the hole.

Still a further object of the invention is to provide stabilizer means associated with the post form and post collar which includes a clamp ring formed by a ring wall having an interrupted portion, clamp means overlying and bridging the interrupted portion, the clamp means constructed so as to draw the opposed ends of the interrupted portion together and positionally lock in a closed position, the ring wall further provided with a plurality of tie means mounted thereon along the outer surface thereof and a plurality of stabilizer rods constructed to attach to the tie means at one end, and for attachment to the underlying ground or support surface at the other end thereby to stabilize the entire post form and holder therefor when in the use position in the field.

In connection with the foregoing object, it is yet a further object of the invention to provide a post footing form holder and stabilizer system of the type described wherein the tie means consists of a plurality of tie ears formed by a ring member having a central aperture, the tie ears being fixedly mounted on the ring wall and circumferentially spaced equidistantly about the outer surface of the ring wall.

Further features of the invention pertain to the particular arrangement of the elements and parts whereby the above-outlined and additional operating features thereof are attained.

The invention, both as to its organization and method of operation, together with further objects and advantages thereof will best be understood by reference to the following specification, taken in connection with the accompanying drawings as described below.

Figure 2:
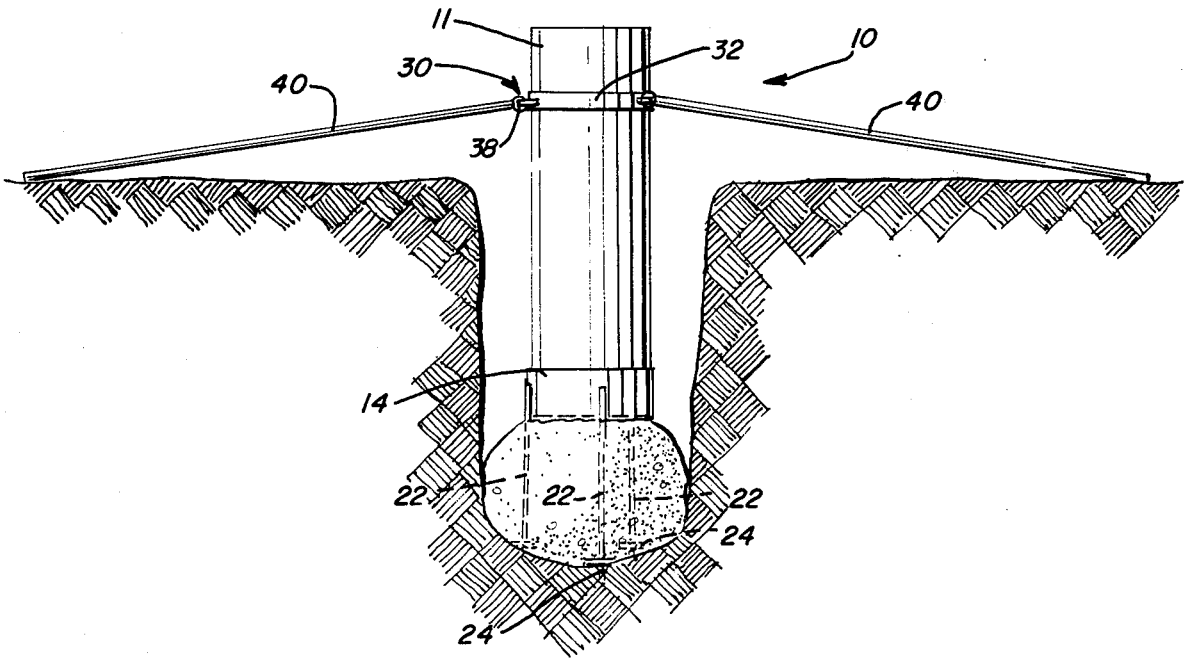
FIG. 2 is a side elevational view showing the entire post footing form holder and stabilizer means in position with concrete footing material poured through the form and into the post hole.
Figure 3:
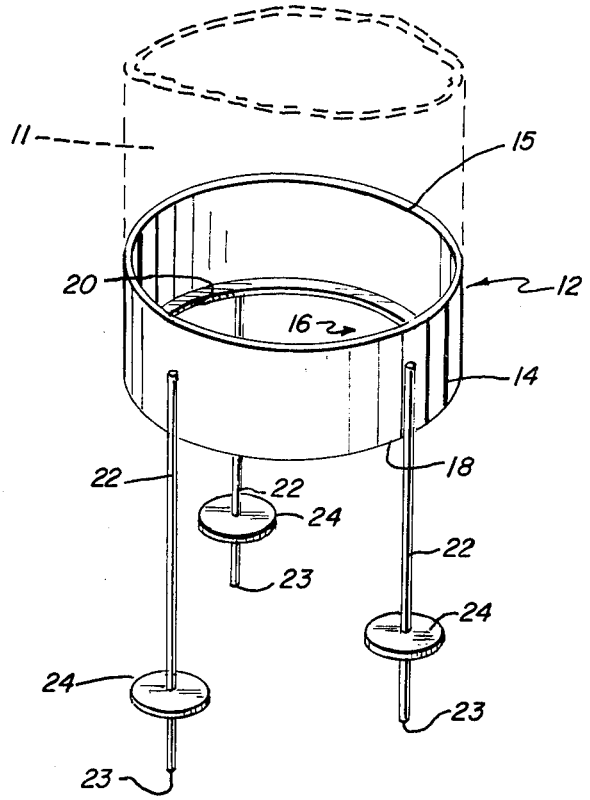
FIG. 3 is a plane view showing the post form holder collar including a series of three legs with stop plates associated therewith.
Figure 4:
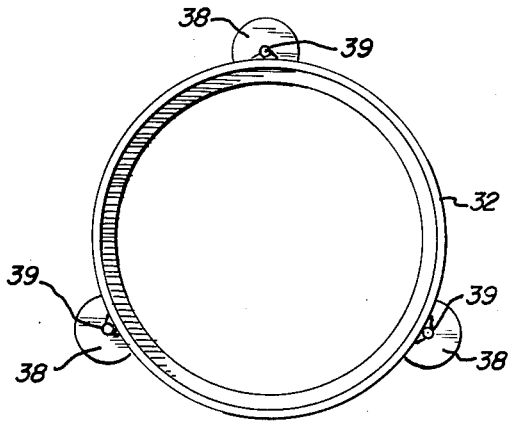
FIG. 4 is a top view of the ring clamp showing the plurality of tie ears mounted thereon.

With reference to the drawings, specifically FIGS. 2, 3, and 4 thereof, the post footing form holder and stabilizer system, generally referred to by the numeral 10 is illustrated. With specific reference to FIG. 3 of the drawings, the post form holder 12 is shown to be formed of a cylindrical collar 14 having an open top end represented by the numeral 15 and an open bottom end represented by the numeral 16. The bottom end 16 terminates in a bottom edge 18 and further includes a circumferential peripheral flange 20 mounted on the bottom edge 18 and extending inwardly a short distance.

It will be apparent from FIGS. 2 and 3 of the drawings that a post form 11 may be inserted through the collar 14 and at that point, the lower end of the form 11 will rest against the peripheral flange 20. It is apparent that since the post form is cylindrical and hollow, when the footing material is poured through the form 11, the same will exit through the bottom of the collar 14 and spread below the collar 14 in the manner illustrated in FIGS. 2 and 5 of the drawings.

The collar 14 further includes a series of three legs 22 which are mounted to the collar 14 in any suitable manner. In the embodiment illustrated in the drawings, the legs 22 are mounted to the collar 14 by weldments, although it is contemplated to be within the scope of the invention to provide leg sleeves formed integrally with the collar 14 such that the legs 22 may simply be inserted in the sleeves and snap into a locked position. However, it will be clear that any manner of mounting the legs 22 to the collar 14 may be utilized as long as the mounting thereof results in a secure mounting of the legs 22 thereon.

It will further be observed that the legs 22 terminate in a lower end 23 and as contemplated within the scope of the invention, the lower ends 23 of the legs 22 are inserted into the ground in the post hole. Each of the legs is further provided with a stop plate 24 which is mounted thereon and positioned in a spaced relationship with respect to the lower ends 23 of the legs 22.

In operation, the post form holder 12 is inserted into the post hole with the post form 11 positioned therein The legs 22 are pressed into the ground at the lower end of the post hole such that lower ends 23 thereof are forced into the ground. The post form holder 12 comes to a rest position when the stop plates 24 meet with and rest against the ground surface at the bottom of the post hole. In this position, the bottom portion of the post form 11 as the same rest against the peripheral flange 20 is maintained in an upwardly spaced posture with respect to the lower portion of the post hole. This spacing is the distance between the stop plates 24 and the bottom end 16 of the collar 14. Hence, as the footing material such as concrete or the like is poured through the post form 11 and exits through the open bottom end 16 of the collar 14, the footing material will flow freely around the legs 22 and will actually form a mass having a larger cross sectional diameter then the diameter of the post form 11. This is clearly illustrated in FIGS. 2 and 5 of the drawings.

The stabilizer system, generally referred to by the numeral 30, generally includes a clamp ring 32 which is cylindrical in configuration and includes an interrupted portion represented by the numeral 33. Overlying and bridging the interrupted portion 33 is a tension clamp 34 which includes a handle portion 35 designed to be pivotally mounted at pivotal point 36 directly on the clamp body 34. It will become apparent that the clamp handle 35 may be pivoted around the pivot point 36 into a down closed position which then has the effect of drawing together the interrupted portion 33 of the clamp ring 32.

The outer peripheral surface of the clamp ring 32 is shown to be provided with a series of 3 tie ears 38 which include central apertures 39 positioned therein. The tie ears 38 are mounted to the clamp ring 32 by any suitable means, such as weldments or the like. The stabilizer system 30 is completed by the provision of stabilizer rods 40 which are provided with attachment hooks 42 for attachment to the central apertures 39 of each of the tie ears 38. At the opposed end of each stabilizer rod, an apertured configuration may be provided, or any other suitable construction may be provided such that the outer terminal ends of the stabilizer rods 40 may be staked into the ground. In the practical operation, the stabilizer system 30 is employed to stabilize the upper portion of the post form 11 once properly positioned in the post holder 12 and once inserted into a suitable post hole. As shown in FIG. 2 of the drawings, the post form 11 is positioned within the cylindrical collar 14 until the lower end of the post form 11 rests against the peripheral flange 20. The post form 11 positioned within the post form holder 12 is then lowered into a post hole until the lower ends 23 of the legs 22 are forced into the ground at the lower end of the post hole. Once the stop plates 24 come to rest against the ground level within the hole, the clamp ring 32 may then be positioned around the post form 11 at a point spaced upwardly from the top end of the post hole. The stabilizer rods 40 are attached to the tie ears 38 by means of the attachment hooks 42 at one end of the stabilizer rods 40, and the opposed end of the rods 40 are then staked into the ground. As depicted in FIG. 4 of the drawings, where a series of three tie ears 38 are provided, and hence, three stabilizer rods 40 may be provided, a relatively secure vertical positioning of the post form 11 relative to the post hole is obtained. Hence, once the concrete or other footing material is poured through the form 11 and exits through the open bottom end 16 of the collar 14, the concrete or other footing material has a tendency to spread out along the bottom portion of the hole thereby enveloping the legs 22. In addition, the cross sectional diameter of the portion of the footing below the bottom end 16 of the collar 14 provides a secure lower footing portion for the post form and the resulting post formed thereby and hence, the remaining open portions of the post hole may be filled with backfill as depicted in FIG. 5 of the drawings.

Figure 1:
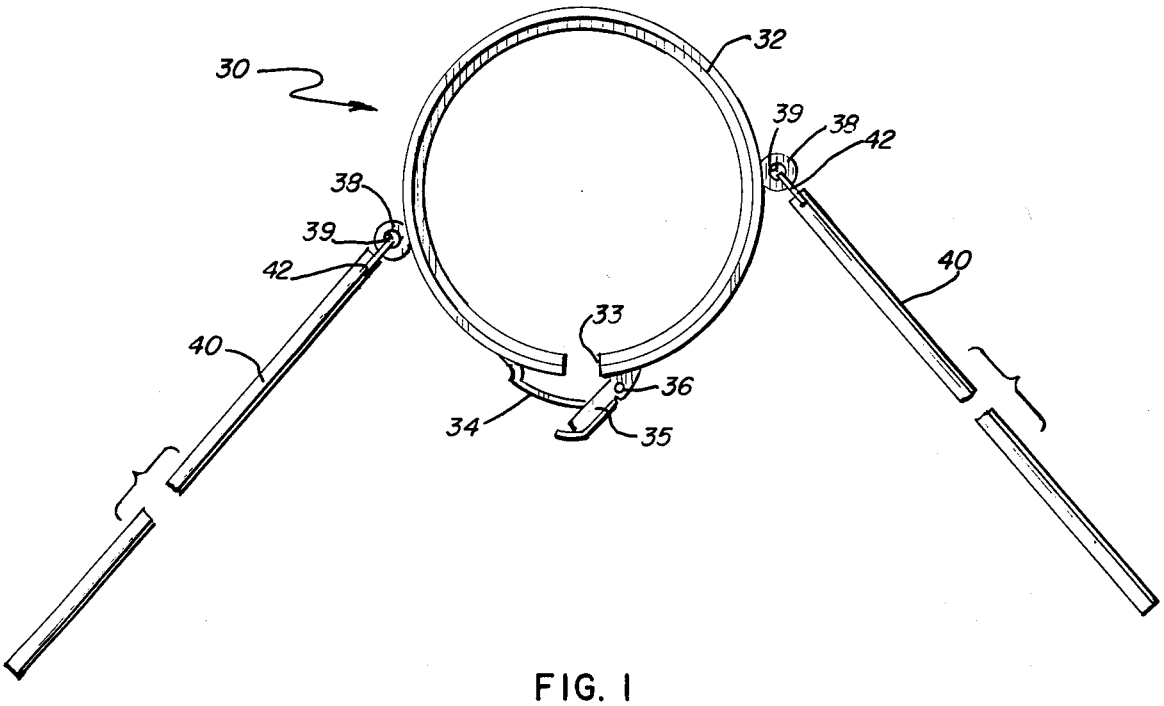
FIG. 1 is a top view of the stabilizer means including the ring clamp and stabilizer rods.

Once the post form 11 in the holder 14 has been appropriately positioned within the post hole, the stabilizer system 30 may then be applied in order to maintain the post form 11 in its proper vertical orientation. As shown in FIG. 1 of the drawings, the clamp ring 32 includes the interrupted portion 33 such that the inside diameter of the clamp ring 32 is slightly greater then the outside diameter of the post form 11. Once inserted about the post form 11, the clamp ring 34 is closed by pivoting the handle 35 about the pivot point 36 thereby drawing the interrupted portion 33 together. It will be apparent that the clamp ring 32 and post form 11 are accordingly sized such that upon clamping the tension clamp 34 closed, the clamp ring 32 will fit tightly about the outer periphery of the post form 11. The stabilizer rods 40 are then attached to the tie ears 38 as indicated previously, and the outer terminal ends are then staked into the ground. This operation is accomplished in a minimum amount of time and in addition, during the staking operation, the operators can insure that a perfectly vertical disposition of the post form 11 is maintained.

It will also be appreciated that once the post form 11 has been accordingly staked into the ground, the post footing material, most commonly concrete, is then poured into the post form 11, the stabilizer system 30 operates to maintain the post form 11 in a perfectly vertical orientation even when confronted with the pressure of concrete as the same strikes against the interior sidewalls of the post form 11 and runs down through the form 11 and out of the open bottom end 16 of the collar 14. It will also be appreciated that the present invention provides a post form holder and stabilizer system which is extremely efficient in operation in terms of a minimal amount of labor time expended in order to erect the post form in position in a manner which insures a completely vertical disposition of the form 11 during the staking operation as well as during the pouring operation.

Figure 5:
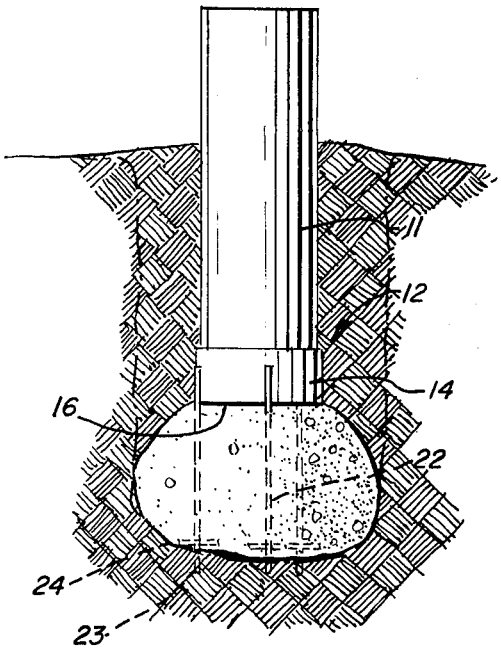
FIG. 5 is a side elevational view showing the post footing form holder, post form, and the hardened post footing material in position within the post hole including the backfill therein.

As further shown in FIG. 5 of the drawings, once the concrete footing and post has dried, the upper portion of the post and form may be cut at any desired height depending upon the particular useage to which the footing is to be applied. For example, the level may vary depending upon whether the footing is to be used in conjunction with lashing down the various units of a modular home as opposed to tie down systems for a mobile home. Alternatively, the subject system may be utilized for forming concrete posts in a very simple and efficient manner such that a complete fence may be erected in a short period of time.

It will be apparent from the above description and drawings, that the present invention does provide a labor saving and efficient post form holder and stabilizer system incident to a system for producing concrete footing utilized for a variety of applications. It will further be apparent that the system described and claimed herein is efficient from a labor standpoint as well insuring a more stable and vertically secure post form holder and stabilizer system.

While there has been described what is at present considered to be the preferred embodiment of the invention, it will be understood that various modifications may be made therein and it is intended to cover in the appended claims all such modifications as fall within the true spirit and scope of the invention.

What is claimed is:

1. A post footing form holder and stabilizer system for use in conjunction with a post form and stabilizer means for positioning and retaining the post form in its use position, comprising in combination, a collar formed by a peripheral side wall and having an open top end and an open bottom end bounded by a bottom edge, said open bottom end having a flange positioned along the bottom edge and extending inwardly for a distance, said collar being dimensionally sized to accommodate the positioning of the post form therein and said flange functioning as a bottom stop for the post form once inserted within said collar, a plurality of legs mounted on said collar and extending downwardly therefrom and terminating in a lower end, said legs being provided with stop means mounted thereon and spaced a distance upwardly from said lower end of said legs, stabilizer means associated with said collar and post form for stabilizing and maintaining the post form and collar in position when forming a post footing, said stabilizer means comprising, a clamp ring formed by a ring wall having an interrupted portion, a tension clamp overlying and bridging said interrupted portion, said tension clamp constructed so as to draw the opposed ends of said interrupted portion together and positionally lock in a closed position, said ring wall further provided with a plurality of tie means mounted thereon along the outer surface thereof, and a plurality of stabilizer rods constructed so as to attach to said tie means at one end and for attachment to an underlying support surface at the other end, whereby said clamp ring may be circumferentially positioned about the post form while the tension clamp is positionally locked such as to firmly retain said clamp ring about the post form, while said stabilizer rods are then attached to said tie means at one end and secured to the underlying support surface at the other end thereby to firmly retain and position the clamp ring, and in turn, the post form in position.

2. The post footing form holder and stabilizer system as set forth in claim 1, wherein said tie means comprises a plurality of tie ears formed by a ring member having a central aperture, said tie ears being fixedly mounted on said ring wall in spaced relation about said ring wall one with respect to the other.

3. The post footing form holder and stabilizer system as set forth in claim 2, wherein said ring wall is provided with a series of three tie ears circumferentially and equidistantly spaced about said ring wall and extending outwardly therefrom for a short distance.

4. A post footing form holder and stabilizer system for use in conjunction with a post form and stabilizer means for positioning and retaining the post form in its use position, comprising in combination, a collar formed by a peripheral side wall and having an open top end and an open bottom end bounded by a bottom edge, said open bottom end having a flange positioned along the bottom edge and extending inwardly for a distance, said collar being dimensionally sized to accommodate the positioning of the post form therein and said flange functioning as a bottom stop for the post form once inserted within said collar, a plurality of legs mounted on said collar and extending downwardly therefrom and terminating in a lower end, said legs being provided with stop means mounted thereon and spaced a distance upwardly from said lower end of said legs, and stabilizer means formed by a clamp ring consisting essentially of a ring wall having an interrupted portion, clamp means associated with said interrupted portion and constructed so as to draw the opposed ends of said interrupted portion together and positionally lock the same in the closed position, said ring wall further provided with a plurality of tie means positionally mounted along the outer surface thereof, and a plurality of stabilizer rods constructed so as to attach to said tie means at one end and for attachment to an underlying support surface at the opposed end, whereby a post footing may be formed by insertion of the post form into said collar while said legs to said collar are positioned to an appropriate post hole and inserted therein until said stop means rest against the surface of the surrounding ground, and said clamp ring is positionably locked about the post form and held firmly in position by said stabilizer rods which are attached at their one end to said clamp ring and at the opposed end to the underlying support surface such that the post footing material may then be poured through the form and exit through the bottom end of said collar to flow freely about said leg and form a post footing having a diameter greater than the diameter of said post form.

5. The post footing form holder and stabilizer system as set forth in claim 4 wherein said clamp means comprises a tension clamp overlying and bridging said interrupted portion, said tension clamp constructed so as to draw the opposed ends of said interrupted portion together and positionably lock in a closed position with the ends of said interrupted portion of said ring wall and said ring wall firmly retained about the post form.

6. The post footing form holder and stabilizer system as set forth in claim 5, wherein said tie means comprises a plurality of tie ears formed by a ring member having a central aperture, said tie ears being fixedly mounted on said ring wall and in spaced relation about said ring wall one with respect to the other.

7. The post footing form holder and stabilizer system as set forth in claim 6, wherein said ring wall is provided with a series of three tie ears circumferentially and equidistantly spaced about said ring wall and extending outwardly therefrom for a short distance.

* * * * *